US010056677B2

(12) United States Patent
Chiang

(10) Patent No.: US 10,056,677 B2
(45) Date of Patent: Aug. 21, 2018

(54) EXTERNAL ANTENNA DEVICE AND ANTENNA STRUCTURE THEREOF

(71) Applicant: AUDEN TECHNO CORP., Taoyuan County (TW)

(72) Inventor: Chi-Ming Chiang, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 54 days.

(21) Appl. No.: 15/407,437

(22) Filed: Jan. 17, 2017

(65) Prior Publication Data

US 2018/0205136 A1 Jul. 19, 2018

(51) Int. Cl.

| | |
|---|---|
| ***H01Q 1/38*** | (2006.01) |
| ***H01Q 1/24*** | (2006.01) |
| ***H01Q 1/48*** | (2006.01) |
| ***H01Q 9/06*** | (2006.01) |

(52) U.S. Cl.
CPC ..... *H01Q 1/241* (2013.01); *H01Q 1/38* (2013.01); *H01Q 1/48* (2013.01); *H01Q 9/065* (2013.01)

(58) Field of Classification Search
CPC ..... H01Q 1/38; H01Q 1/48; H01Q 1/241; H01Q 9/065
See application file for complete search history.

(56) References Cited

U.S. PATENT DOCUMENTS

2008/0246685 A1* 10/2008 Ying ..... H01Q 1/243 343/878

* cited by examiner

*Primary Examiner* — Andrea Lindgren Baltzell
(74) *Attorney, Agent, or Firm* — Li & Cai Intellectual Property (USA) Office

(57) ABSTRACT

An antenna structure of an external antenna device includes an elongated substrate, a grounding segment, an antenna segment, a matching module, and a low-frequency extending segment, the latter four of which are disposed on the substrate. The grounding segment and the low-frequency extending segment are respectively arranged on two opposite sides of the antenna segment. The antenna segment includes a feeding portion, a high-frequency portion, and a low-frequency portion. The high-frequency portion and the low-frequency portion are electrically connected to the feeding portion and the grounding segment via the matching module. The low-frequency portion and the low-frequency extending segment each has a signal path, and a total length of the two signal paths is 0.375~0.625 times of a wavelength corresponding to a center frequency of a low-frequency band. The low-frequency extending segment is arranged apart from and is electrically coupled to the low-frequency portion.

10 Claims, 9 Drawing Sheets

EXTERNAL ANTENNA DEVICE AND ANTENNA STRUCTURE THEREOF

BACKGROUND OF THE INVENTION

1. Field of the Invention

The instant invention relates to an antenna; in particular, to an external antenna device and an antenna structure thereof.

2. Description of Related Art

The conventional antenna device can be classified into an internal antenna structure embedded in an electronic device (e.g., a mobile phone), and an external antenna structure installed outside an electronic device (e.g., a router). Generally, in order to improve the gain of the external antenna structure, either the low-frequency antenna of the external antenna structure is integrally extended to increase a length thereof, or the low-frequency antenna is connected to a radiating portion of the external antenna structure. However, in operation of the above external antenna structure, the frequency band of the above external antenna structure is restricted. Moreover, an impedance offset problem easily occurs when connecting the low-frequency antenna to the radiating portion.

SUMMARY OF THE INVENTION

The instant disclosure provides an external antenna device and an antenna structure thereof for effectively improving the drawbacks associated with conventional external antenna devices.

The instant disclosure provides an external antenna device for being mounted outside of an electronic device. The external antenna device includes a connecting carrier, an elongated case, a signal cable, and an antenna structure. The connecting carrier is provided for being detachably mounted on the electronic device. The case has an accommodating space and an opening in air communication with the accommodating space. A part of the connecting carrier is inserted into the opening of the case to seal the accommodating space. A part of the signal cable is inserted into the connecting carrier, and the other part of the signal cable is arranged in the accommodating space. The signal cable includes a free end portion and a fixing end portion, and the free end portion is configured to electrically connect to the electronic device. The antenna structure is arranged in the accommodating space and is configured to be operated in a high-frequency band and a low-frequency band. The antenna structure includes an elongated substrate, a grounding segment, an antenna segment, a matching module, and a low-frequency extending segment, the latter four of which are disposed on the substrate. The substrate defines a longitudinal direction. The antenna segment includes a feeding portion, a high-frequency portion, and a low-frequency portion. The fixing end portion of the signal cable is electrically connected to the grounding segment and the feeding portion. The high-frequency portion and the low-frequency portion are respectively and electrically connected to the feeding portion and the grounding segment via the matching module. The low-frequency extending segment and the grounding segment are respectively arranged on two opposite sides of the antenna segment. The low-frequency portion and the low-frequency extending segment each has a signal path, and a total length of the two signal paths is 0.375~0.625 times of a wavelength corresponding to a center frequency of the low-frequency band. The low-frequency extending segment is arranged apart from the low-frequency portion with a gap and is electrically coupled to the low-frequency portion.

The instant disclosure also provides an antenna structure of an external antenna device for operating in a high-frequency band and a low-frequency band. The antenna structure includes an elongated substrate, a grounding segment, an antenna segment, a matching module, and a low-frequency extending segment, the latter four of which are disposed on the substrate. The substrate defines a longitudinal direction. The antenna segment includes a feeding portion, a high-frequency portion, and a low-frequency portion. The high-frequency portion and the low-frequency portion are respectively and electrically connected to the feeding portion and the grounding segment via the matching module. The low-frequency extending segment and the grounding segment are respectively arranged on two opposite sides of the antenna segment. The low-frequency portion and the low-frequency extending segment each has a signal path, and a sum of the two signal paths is 0.375~0.625 times of a wavelength corresponding to a center frequency of the low-frequency band. The low-frequency extending segment is arranged apart from the low-frequency portion with a gap and is electrically coupled to the low-frequency portion.

In summary, the low-frequency portion and the low-frequency extending segment are electrically coupled with each other so as to provide the signal paths along the total length, which is 0.375~0.625 times of the wavelength corresponding to the center frequency of the low-frequency band. Thus, the gain of the antenna structure can be increased, and the frequency band of the antenna structure can be larger than the conventional values of the prior art.

In order to further appreciate the characteristics and technical contents of the instant invention, references are hereunder made to the detailed descriptions and appended drawings in connection with the instant invention. However, the appended drawings are merely shown for exemplary purposes, and should not be construed as restricting the scope of the instant invention.

DETAILED DESCRIPTION OF THE PREFERRED EMBODIMENTS

References are hereunder made to the detailed descriptions and appended drawings in connection with the instant invention. However, the appended drawings are merely provided for exemplary purposes, and should not be construed as restricting the scope of the instant invention.

Figure 1:
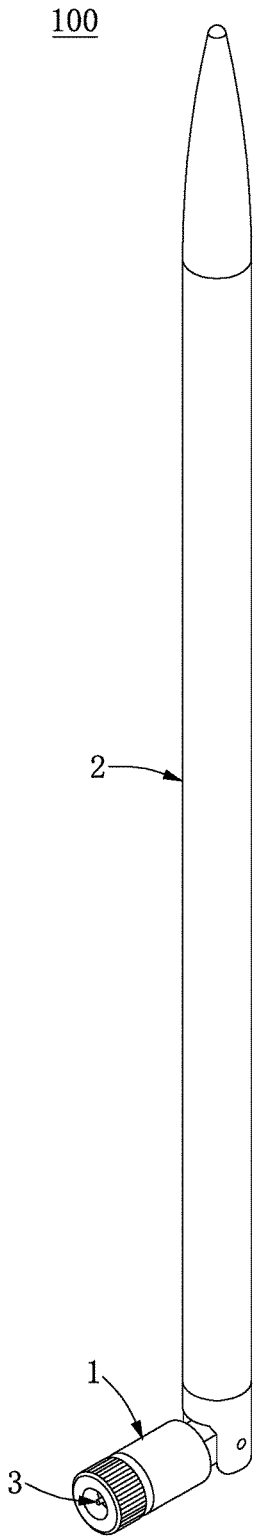
FIG. 1 is a perspective view showing an external antenna device according to the instant disclosure.
Figure 2:
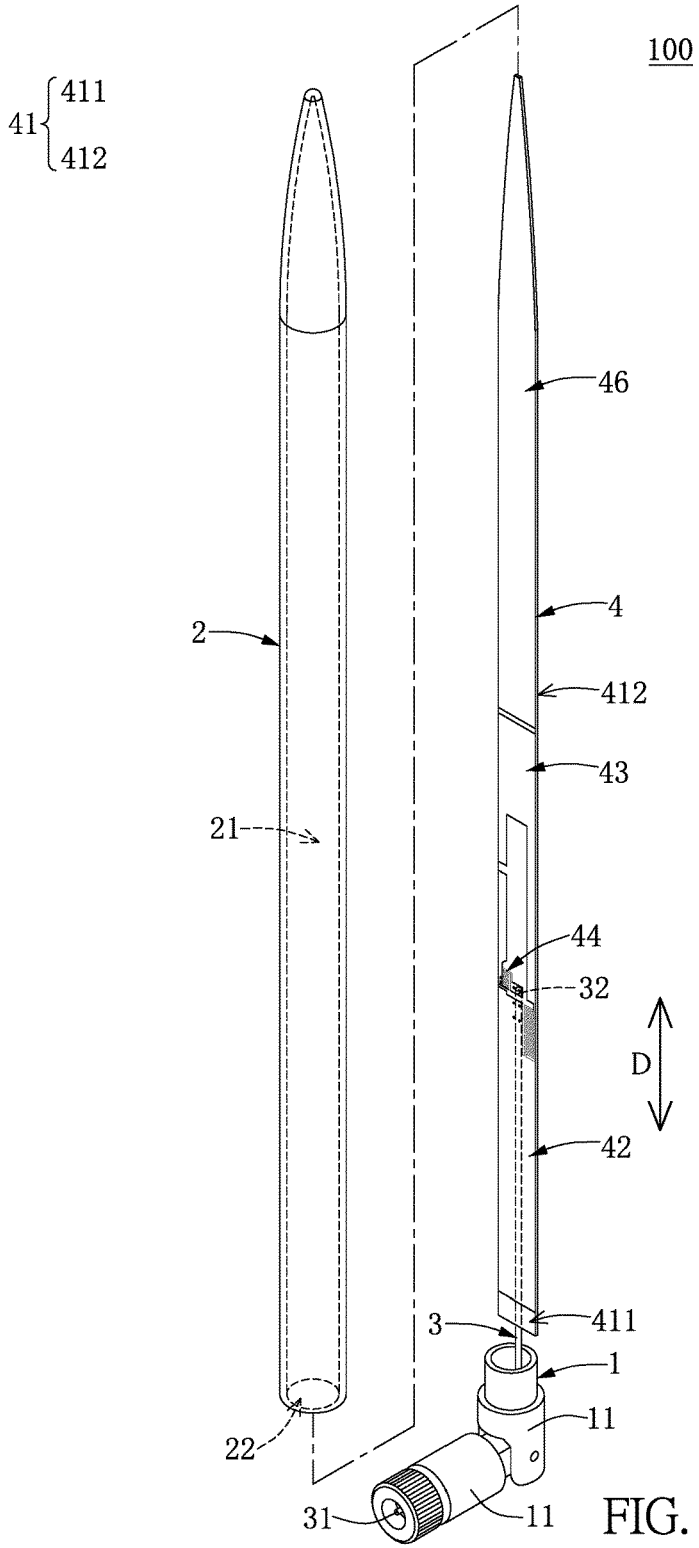
FIG. 2 is an exploded perspective view of FIG. 1.

Reference is made to FIGS. 1 through 9, which show an embodiment of the instant disclosure. As shown in FIGS. 1 and 2, the instant embodiment provides an external antenna device 100 for being detachably mounted on an electronic device (e.g., a router). That is to say, the external antenna device 100 of the instant embodiment is different from an antenna (e.g., a mobile antenna) arranged in an electronic device. The external antenna device 100 includes a connecting carrier 1, an elongated case 2 installed on the connecting carrier 1, a signal cable 3 inserted into the connecting carrier 1 and the case 2, and an antenna structure 4 arranged in the case 2 and electrically connected to the signal cable 3. In addition, the antenna structure 4 in the instant embodiment is cooperated with the connecting carrier 1, the case 2, and the signal cable 3, but the instant disclosure is not limited thereto. The following description discloses structural and connection relationships of each component of the external antenna device 100.

As shown in FIGS. 1 and 2, the connecting carrier 1 is configured to be detachably mounted on the electronic device (e.g., a router). The connecting carrier 1 in the instant embodiment includes two tubes 11 that are pivotally connected to each other and that each have an inner space in air communication with each other.

The case 2 has an accommodating space 21, and an opening 22 in air communication with the accommodating space 21. The accommodating space 21 in the instant embodiment is communicated with an exterior environment of the case 2 only through the opening 22. Moreover, a part of the connecting carrier 1 is inserted into the opening 22 of the case 2 to seal the accommodating space 21.

A part of the signal cable 3 is inserted into the connecting carrier 1, and the other part of the signal cable 3 is arranged in the accommodating space 21. The signal cable 3 includes a free end portion 31 and a fixing end portion 32. The free end portion 31 is arranged on one of the two tubes 11 arranged away from the case 2 for electrically connecting to the electronic device. The fixing end portion 32 is arranged in the accommodating space 21 of the case 2 and is electrically connected to the antenna structure 4.

Figure 5:
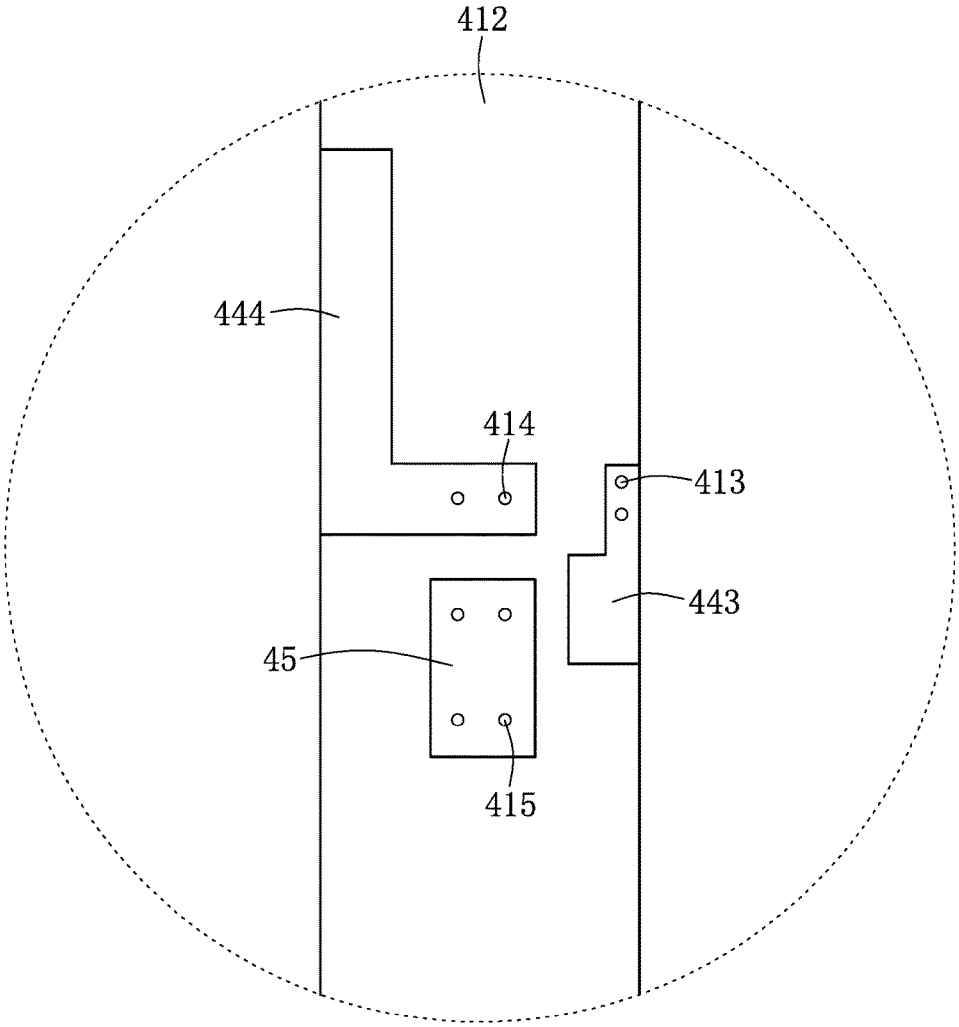
FIG. 5 is an enlarged view showing the IV portion of FIG. 3 from another perspective.
Figure 6:
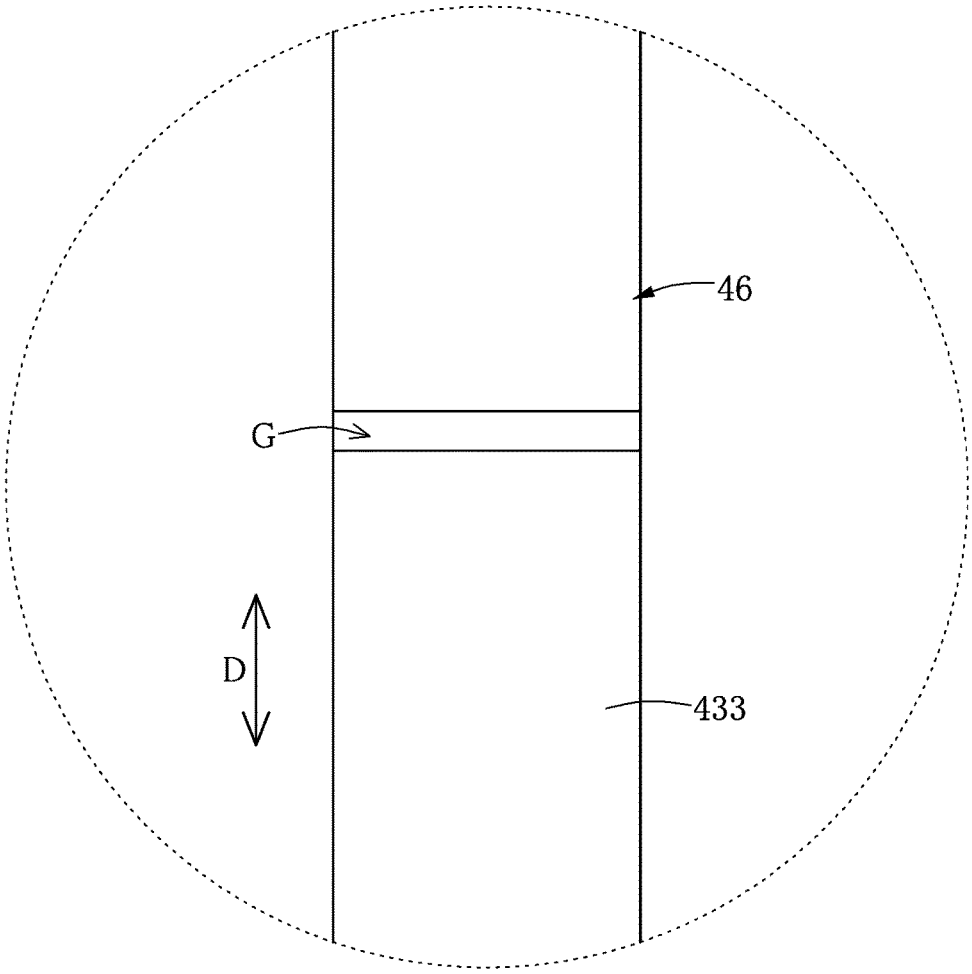
FIG. 6 is an enlarged view showing the VI portion of FIG. 3.

The antenna structure 4 is arranged in the accommodating space 21 of the case 2 and is configured to be operated in a high-frequency band and a low-frequency band. Based on the antenna structure 4 of the instant disclosure, the high-frequency band and the low-frequency band can be larger than the conventional values of the prior art. Specifically, the high-frequency band in the instant embodiment is 1710 MHz~2690 MHz, and the low-frequency band in the instant embodiment is 690 MHz~960 MHz, but the instant disclosure is not limited thereto. The antenna structure 4 includes an elongated substrate 41, a grounding segment 42, an antenna segment 43, a matching module 44, a soldering pad 45 (as shown in FIG. 5), and a low-frequency extending segment 46, the latter five of which are disposed on the substrate 41.

The substrate 41 defines a longitudinal direction D. The substrate 41 approximately corresponds in shape to a cross-section of the case 2 parallel to the longitudinal direction D, so that the substrate 41 can be inserted into the case 2 in the longitudinal direction D. Moreover, the substrate 41 has a first surface 411 and an opposite second surface 412.

Figure 3:
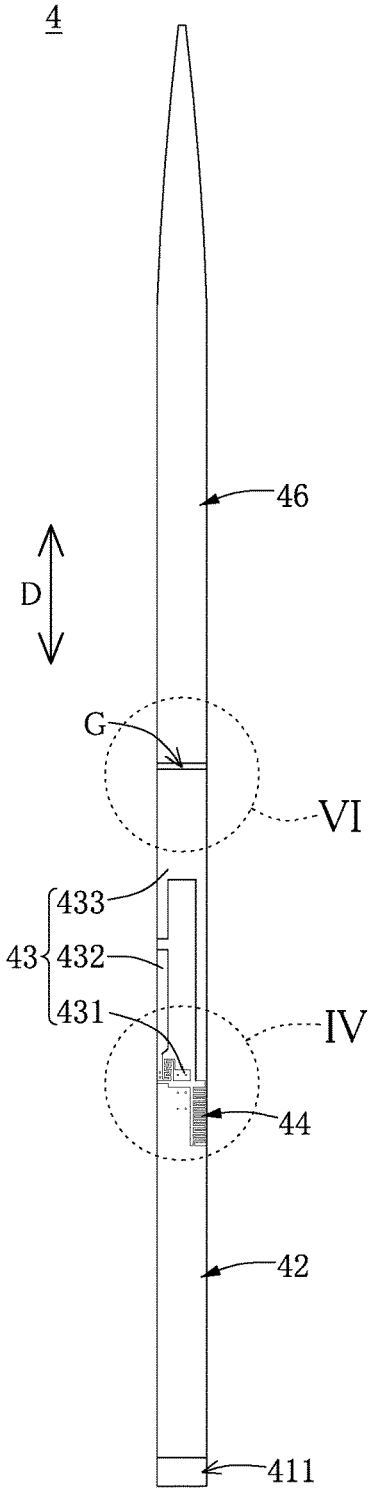
FIG. 3 is a planar view showing the antenna structure of FIG. 2.
Figure 4:
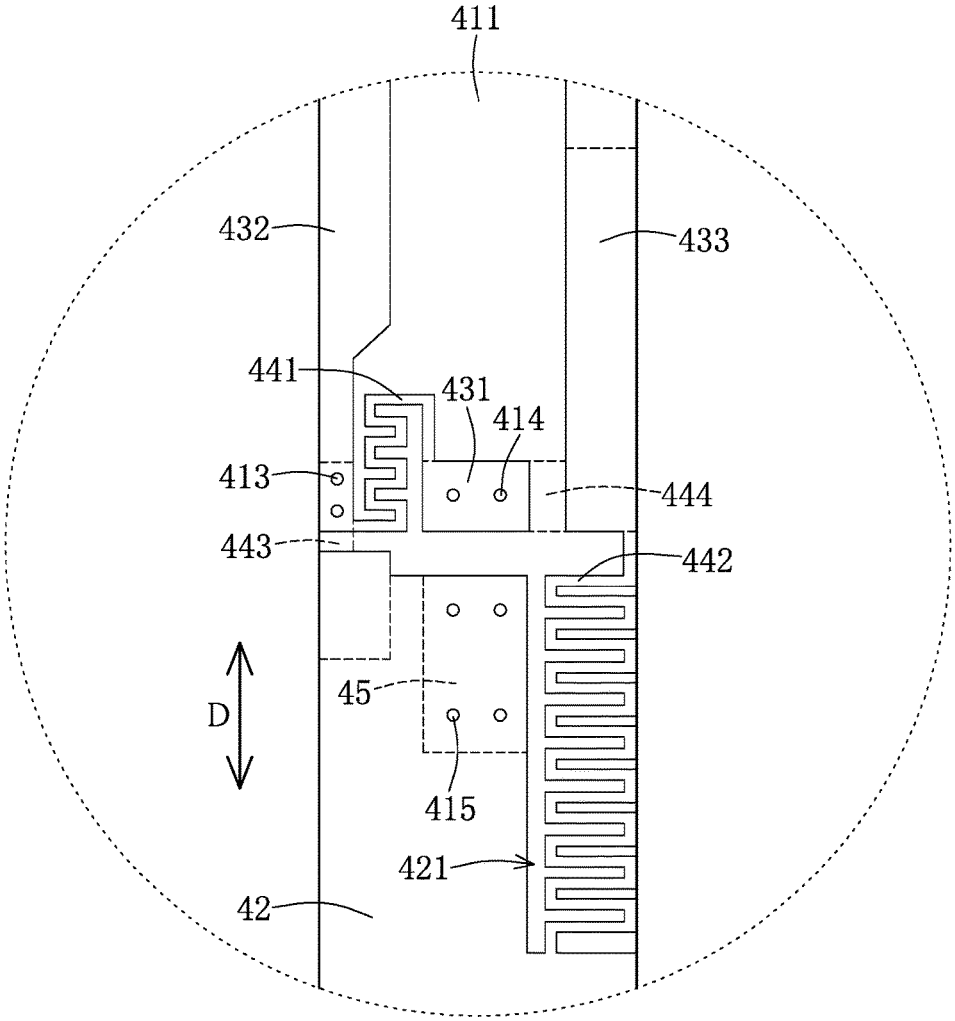
FIG. 4 is an enlarged view showing the IV portion of FIG. 3.

As shown in FIGS. 2 to 4, the grounding segment 42 is disposed on the first surface 411 of the substrate 41 and is arranged close to the connecting carrier 1. The grounding segment 42 in the instant embodiment has a straight shape, and a notch 421 (as shown in FIG. 4) is formed on a corner of the grounding segment 42 away from the connecting carrier 1. Specifically, a signal path of the grounding segment 42 has a length substantially equal to 0.125 times of a wavelength corresponding to a center frequency of the low-frequency band. The length of the signal path of the grounding segment 42 is equal to a length of the grounding segment 42 in the longitudinal direction D.

As shown in FIGS. 2 to 5, the antenna segment 43 is disposed on the first surface 411 of the substrate 41. The antenna segment 43 includes a feeding portion 431, a high-frequency portion 432, and a low-frequency portion 433. In the instant embodiment, the high-frequency portion 432 and the low-frequency portion 433 are arranged apart from each other and approximately form a U shape, with a trough of the U shape facing toward the grounding segment 42. The feeding portion 431 is substantially arranged in the trough and is arranged closed to the grounding segment 42. Moreover, an end of the high-frequency portion 432 and an end of the low-frequency portion 433 (i.e., two free ends of the U shape) are respectively arranged at two opposite sides of the feeding portion 431 and are arranged close to the grounding segment 42.

The fixing end portion 32 of the signal cable 3 is electrically connected to the grounding segment 42 and the feeding portion 431. The high-frequency portion 432 and the low-frequency portion 433 are respectively and electrically connected to the feeding portion 431 and the grounding segment 42 via the matching module 44. The matching module 44 includes a high-frequency microstrip 441, a low-frequency microstrip 442, a high-frequency coupling pad 443, and a low-frequency coupling pad 444. The high-frequency microstrip 441 and the low-frequency microstrip 442 are disposed on the first surface 411 of the substrate 41. The high-frequency coupling pad 443 and the low-frequency coupling pad 444 are disposed on the second surface 412 of the substrate 41.

Specifically, two opposite ends of the high-frequency microstrip 441 are respectively connected to the feeding portion 431 and the high-frequency portion 432, so that the high-frequency microstrip 441 provides an inductance function between the feeding portion 431 and the high-frequency portion 432. Two opposite ends of the low-frequency microstrip 442 are respectively connected to the grounding segment 42 and the low-frequency portion 433, so that the low-frequency microstrip 442 provides an inductance function between the grounding segment 42 and the low-frequency portion 433. The low-frequency microstrip 442 in the instant embodiment is approximately arranged in the notch 421 of the grounding segment 42.

Moreover, the high-frequency coupling pad 443 is electrically connected to the high-frequency portion 432 via at least one first conductive pillar 413 embedded in the substrate 41. That is to say, two opposite ends of the first conductive pillar 413 are respectively connected to the high-frequency coupling pad 443 and the high-frequency portion 432. The high-frequency coupling pad 443 is configured to electrically couple to the grounding segment 42. Thus, a portion of the substrate 41 corresponding in position to the high-frequency coupling pad 443 can provide a capacitance function between the grounding segment 42 and the high-frequency portion 432. The low-frequency coupling pad 444 is electrically connected to the feeding portion 431 via at least one second conductive pillar 414 embedded in the substrate 41. That is to say, two opposite ends of the second conductive pillar 414 are respectively connected to the low-frequency coupling pad 444 and the feeding portion 431. The low-frequency coupling pad 444 is configured to electrically couple to the low-frequency portion 433. Thus, a portion of the substrate 41 corresponding in position to the low-frequency coupling pad 444 can provide a capacitance function between the feeding portion 431 and the low-frequency portion 433.

In addition, the soldering pad 45 is electrically connected to the grounding segment 42 via at least one third conductive pillar 415 embedded in the substrate 41. That is to say, two opposite ends of the third conductive pillar 415 are respectively connected to the soldering pad 45 and the grounding segment 42. The fixing end portion 32 of the signal cable 3 in the instant embodiment is soldered on the soldering pad 45 and the low-frequency coupling pad 444, thereby electrically connecting to the grounding segment 42 and the feeding portion 431.

As shown in FIGS. 3 to 6, the low-frequency extending segment 46 is arranged away from the connecting carrier 1, in other words, the low-frequency extending segment 46 and the grounding segment 42 are respectively arranged on two opposite sides of the antenna segment 43 (i.e., the upper side and the lower side of the antenna segment 43 as shown in FIG. 3). The low-frequency extending segment 46 is arranged apart from the low-frequency portion 433 of the antenna segment 43 with a gap G, and the gap G does not influence the coupling between the low-frequency extending segment 46 and the low-frequency portion 433. A length of the gap G in the longitudinal direction D is approximately 0.5 mm~1.0 mm, but the instant disclosure is not limited thereto.

Specifically, the low-frequency portion 433 and the low-frequency extending segment 46 each has a signal path, and a total length of the two signal paths of the low-frequency portion 433 and the low-frequency extending segment 46 is 0.375~0.625 times of the wavelength corresponding to the center frequency of the low-frequency band. In the instant embodiment, a length of the signal path of the low-frequency portion 433 is substantially 0.125 times of the wavelength, and a length of the signal path of the low-frequency extending segment 46 is substantially 0.125~0.375 times of the wavelength. It should be noted that the signal path of the low-frequency extending segment 46 is a straight line and is substantially equal to a length of the low-frequency extending segment 46 in the longitudinal direction D. Moreover, the length of the signal path of the low-frequency extending segment 46 in the instant embodiment is substantially 0.375 times of the wavelength, but the instant disclosure is not limited thereto.

Figure 7:
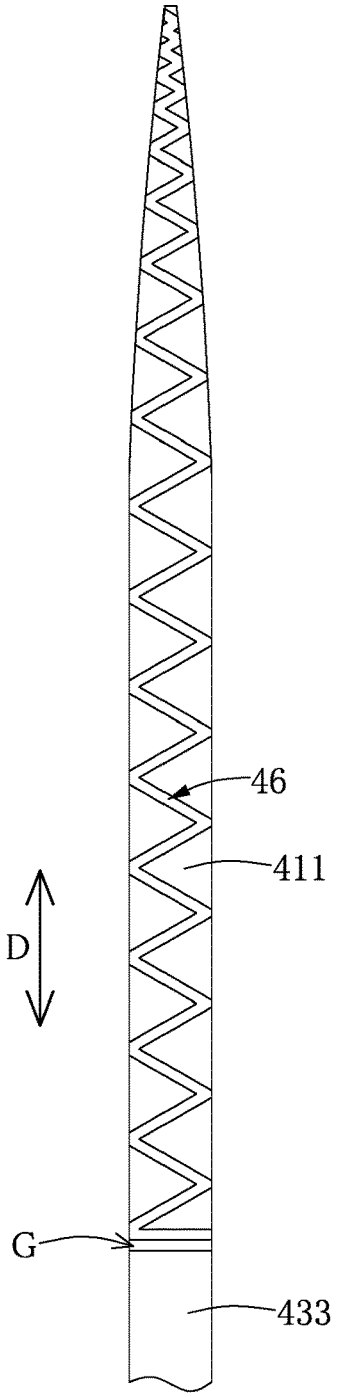
FIG. 7 is a planar view showing part of an antenna structure according to a variety of the instant disclosure.

In addition, while the low-frequency extending segment 46 as shown in FIG. 3 has a straight shape, the shape of the low-frequency extending segment 46 can be changed according to practical needs. For example, as shown in FIG. 7, the low-frequency extending segment 46 can be a curved shape, so that the signal path is a curved line. Thus, if the length of the signal path of the low-frequency extending segment 46 as shown in FIG. 7 is equal to the length of the signal path of the low-frequency extending segment 46 as shown in FIG. 3, the length of the low-frequency extending segment 46 as shown in FIG. 7 in the longitudinal direction D can be smaller, and the substrate 41 can be smaller. In other words, as shown in FIG. 7, the length of the signal path of the low-frequency extending segment 46 is larger than the length of the low-frequency extending segment 46 in the longitudinal direction D.

Figure 8:
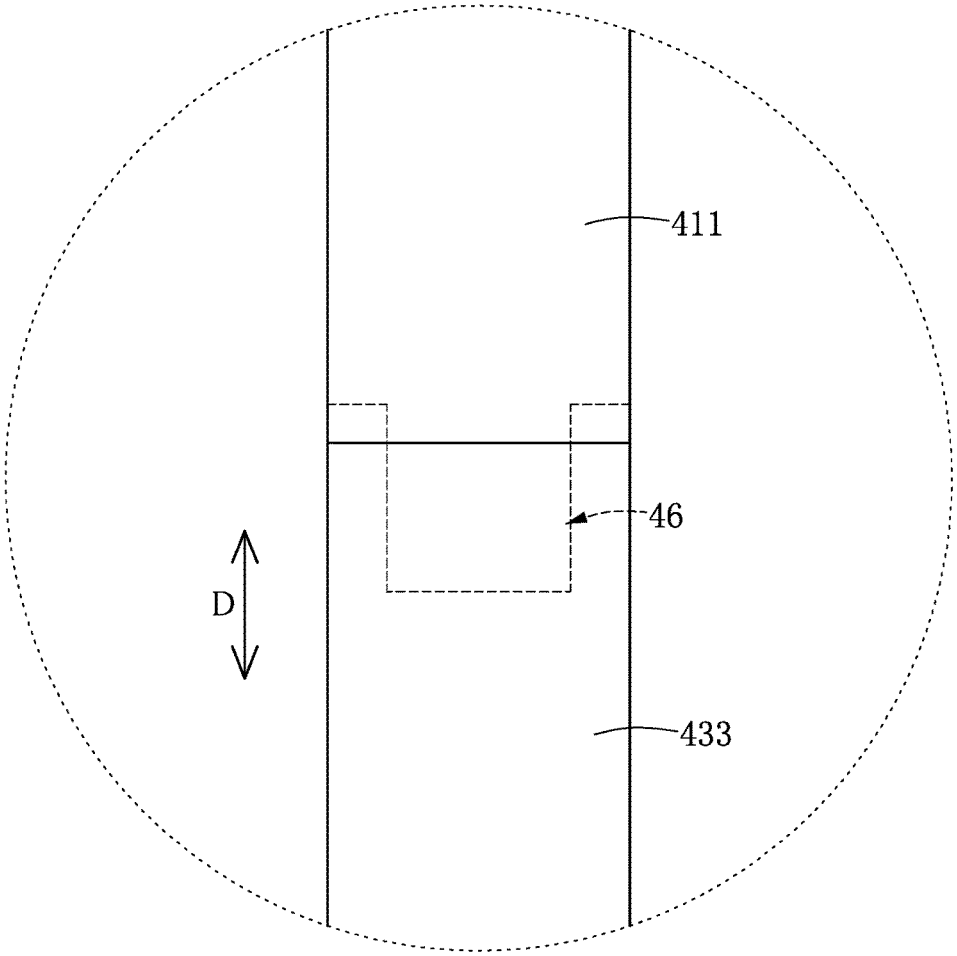
FIG. 8 is a planar view showing part of an antenna structure according to another variety of the instant disclosure.

Moreover, the grounding segment 42, the antenna segment 43, and the low-frequency extending segment 46 as shown in FIG. 3 are disposed on the first surface 411 of the substrate 41, but the instant disclosure is not limited thereto. For example, as shown in FIG. 8, the low-frequency extending segment 46 can be disposed on the second surface 412 of the substrate 41, and a part of the low-frequency extending segment 46 is arranged under the low-frequency portion 433, so that the low-frequency extending segment 46 can electrically couple to the low-frequency portion 433. Moreover, a portion of the substrate 41 arranged between the low-frequency portion 433 and the low-frequency extending segment 46 can be regarded as a gap between the low-frequency portion 433 and the low-frequency extending segment 46.

Figure 9:
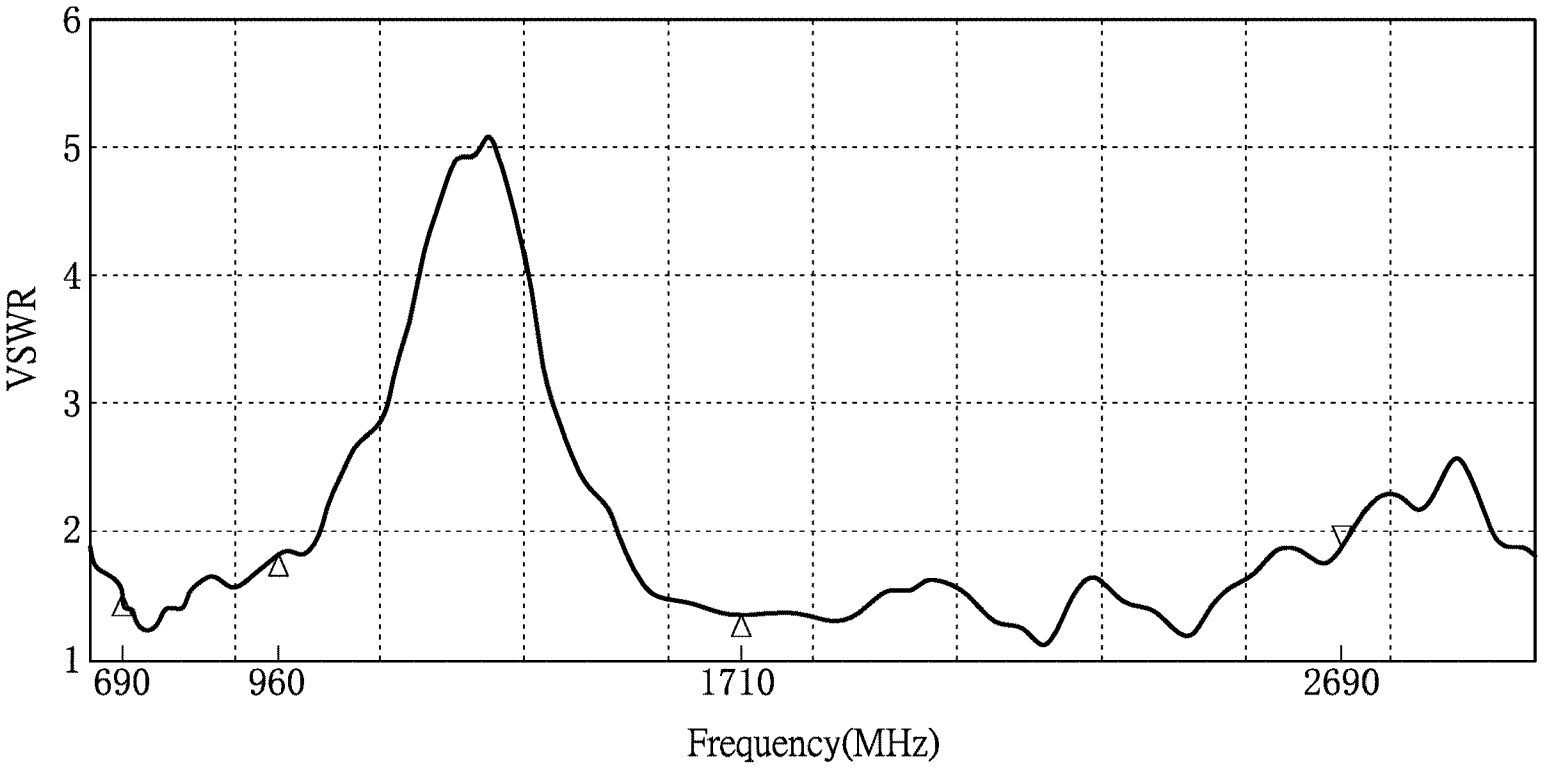
FIG. 9 is a simulation diagram of the external antenna device of FIG. 1.

In summary, the low-frequency portion 433 and the low-frequency extending segment 46 are electrically coupled with each other so as to provide the signal paths of a total length, which is 0.375~0.625 times of the wavelength corresponding to the center frequency of the low-frequency band. Thus, the gain of the antenna structure 4 can be increased (i.e., when the antenna structure 4 is operated in the high-frequency band and the low-frequency band, the gain of the antenna structure 4 is at least 3 dBi), and the frequency band of the antenna structure 4 (as shown in FIG. 9) can be larger than the conventional values of the prior art.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. An external antenna device for being mounted outside of an electronic device, comprising:

a connecting carrier for being detachably mounted on the electronic device;

an elongated case having an accommodating space and an opening in air communication with the accommodating space, wherein a part of the connecting carrier is inserted into the opening of the case to seal the accommodating space;

a signal cable partially inserted into the connecting carrier, the other part of the signal cable being arranged in the accommodating space, wherein the signal cable includes a free end portion and a fixing end portion, and the free end portion is configured to electrically connect to the electronic device; and an antenna structure arranged in the accommodating space and configured to be operated in a high-frequency band and a low-frequency band, the antenna structure including:

an elongated substrate defining an longitudinal direction;

a grounding segment disposed on the substrate;

an antenna segment disposed on the substrate and having a feeding portion, a high-frequency portion, and a low-frequency portion, wherein the fixing end portion of the signal cable is electrically connected to the grounding segment and the feeding portion;

a matching module disposed on the substrate, wherein the high-frequency portion and the low-frequency portion are respectively and electrically connected to the feeding portion and the grounding segment via the matching module; and a low-frequency extending segment disposed on the substrate, wherein the low-frequency extending segment and the grounding segment are respectively arranged on two opposite sides of the antenna segment, wherein the low-frequency portion and the low-frequency extending segment each has a signal path, and a total length of the two signal paths is 0.375~0.625 times of a wavelength corresponding to a center frequency of the low-frequency band, and wherein the low-frequency extending segment is arranged apart from the low-frequency portion with a gap and is electrically coupled to the low-frequency portion.

2. The external antenna device as claimed in claim 1, wherein the grounding segment is arranged adjacent to the connecting carrier, and the low-frequency extending segment is arranged away from the connecting carrier.

3. The external antenna device as claimed in claim 1, wherein the substrate includes a first surface and an opposite second surface, and the grounding segment, the antenna segment, and the low-frequency extending segment are disposed on the first surface of the substrate.

4. The external antenna device as claimed in claim 3, wherein the feeding portion and the high-frequency portion are arranged close to the grounding segment and away from the low-frequency extending segment, and wherein the matching module includes:

a high-frequency microstrip disposed on the first surface, and two opposite ends of the high-frequency microstrip respectively connected to the feeding portion and the high-frequency portion;

a low-frequency microstrip disposed on the first surface, and two opposite ends of the low-frequency microstrip respectively connected to the grounding segment and the low-frequency portion;

a high-frequency coupling pad disposed on the second surface, wherein the high-frequency coupling pad is electrically connected to the high-frequency portion via a first conductive pillar embedded in the substrate and electrically couples to the grounding segment; and a low-frequency coupling pad disposed on the second surface, wherein the low-frequency coupling pad is electrically connected to the feeding portion via a second conductive pillar embedded in the substrate and electrically couples to the low-frequency portion.

5. The external antenna device as claimed in claim 4, wherein the antenna structure includes a soldering pad electrically connected to the grounding segment via a third conductive pillar embedded in the substrate, and wherein the fixing end portion of the signal cable is soldered on the soldering pad and the low-frequency coupling pad.

6. The external antenna device as claimed in claim 1, wherein a length of the signal path of the low-frequency portion is substantially 0.125 times of the wavelength, a length of the signal path of the low-frequency extending segment is substantially 0.125~0.375 times of the wavelength, and a signal path of the grounding segment has a length substantially equal to 0.125 times of the wavelength.

7. The external antenna device as claimed in claim 6, wherein the length of the signal path of the low-frequency extending segment is equal to a length of the low-frequency extending segment in the longitudinal direction, and wherein the length of the signal path of the grounding segment is equal to a length of the grounding segment in the longitudinal direction.

8. The external antenna device as claimed in claim 1, wherein the gap in the longitudinal direction has a length of 0.5~1.0 mm, and wherein a length of the signal path of the low-frequency extending segment is substantially 0.375 times of the wavelength.

9. An antenna structure of an external antenna device for operating in a high-frequency band and a low-frequency band, comprising:

an elongated substrate defining a longitudinal direction;

a grounding segment disposed on the substrate;

an antenna segment disposed on the substrate and including a feeding portion, a high-frequency portion, and a low-frequency portion;

a matching module disposed on the substrate, wherein the high-frequency portion and the low-frequency portion are respectively and electrically connected to the feeding portion and the grounding segment via the matching module; and a low-frequency extending segment disposed on the substrate, wherein the low-frequency extending segment and the grounding segment are respectively arranged on two opposite sides of the antenna segment, wherein the low-frequency portion and the low-frequency extending segment each has a signal path, and a sum of the two signal paths is 0.375~0.625 times of a wavelength corresponding to a center frequency of the low-frequency band, and wherein the low-frequency extending segment is arranged apart from the low-frequency portion with a gap and is electrically coupled to the low-frequency portion.

10. The antenna structure as claimed in claim 9, wherein a length of the signal path of the low-frequency portion is substantially 0.125 times of the wavelength, and a length of the signal path of the low-frequency extending segment is substantially 0.125~0.375 times of the wavelength.

* * * * *